US009804614B2

(12) United States Patent
Ji et al.

(10) Patent No.: US 9,804,614 B2
(45) Date of Patent: Oct. 31, 2017

(54) BANDGAP REFERENCE CIRCUIT AND METHOD FOR ROOM TEMPERATURE TRIMMING WITH REPLICA ELEMENTS

(71) Applicant: Dialog Semiconductor (UK) Limited, Reading (GB)

(72) Inventors: Cang Ji, Kirchheim unter Teck (DE); Siarhei Meliukh, Munich (DE)

(73) Assignee: Dialog Semiconductor (UK) Limited, Reading (GB)

( * ) Notice: Subject to any disclaimer, the term of this patent is extended or adjusted under 35 U.S.C. 154(b) by 0 days.

(21) Appl. No.: 14/713,539

(22) Filed: May 15, 2015

(65) Prior Publication Data

US 2016/0334816 A1 Nov. 17, 2016

(51) Int. Cl.

| | |
|---|---|
| ***G05F 3/30*** | (2006.01) |
| ***G05F 3/22*** | (2006.01) |
| ***G05F 3/24*** | (2006.01) |
| ***G05F 1/46*** | (2006.01) |

(52) U.S. Cl.

CPC ..... *G05F 1/468* (2013.01)

(58) Field of Classification Search

CPC ..... G05F 3/30; G05F 3/222; G05F 3/242

USPC ..... 323/313

See application file for complete search history.

(56) References Cited

U.S. PATENT DOCUMENTS

| | | | | |
|---|---|---|---|---|
| 6,201,379 | B1 * | 3/2001 | MacQuigg | G05F 3/242 323/313 |
| 6,218,822 | B1 * | 4/2001 | MacQuigg | G05F 3/30 323/313 |
| 7,164,259 | B1 * | 1/2007 | Megaw | G05F 3/30 323/313 |
| 7,472,030 | B2 | 12/2008 | Scheuerlein | |

(Continued)

OTHER PUBLICATIONS

"A Single-trim CMOS Bandgap Reference With a 3σ Innaccuraacy of ±0.15% From -40 degrees to 125 degrees C.," by Guang Ge et al., IEEE Journal of solid-State Circuits, vol. 46, No. 11, Nov. 2011, pp. 2693-2701.

*Primary Examiner* — Timothy J Dole
*Assistant Examiner* — Sisay G Tiku
(74) *Attorney, Agent, or Firm* — Saile Ackerman LLC; Stephen B. Ackerman

(57) ABSTRACT

A method and circuit for trimming a bandgap reference are described. The bandgap reference circuit comprises a first diode which is arranged in series with a first resistor between a reference point and a reference potential $V_{SS}$. The circuit also comprises a second diode which is arranged in series with a second resistor and a third resistor between the reference point and the reference potential $V_{SS}$. In addition, the bandgap reference circuit comprises a trimming network, wherein a bandgap reference voltage $V_{BG\ CORE}$ is provided at a midpoint between the trimming network and the current source. The circuit also comprises an operational amplifier. The method (700) comprises measuring a first diode voltage across a replica element of the first diode;

(Continued)

determining a first resistance of a replica element of the first resistor; and setting a resistance of the trimming network using the first diode voltage and the first resistance.

15 Claims, 9 Drawing Sheets

(56) References Cited

U.S. PATENT DOCUMENTS

| | | | | |
|---|---|---|---|---|
| 9,261,415 | B1 * | 2/2016 | Zhang | G05F 3/30 |
| 9,285,822 | B2 * | 3/2016 | Fukazawa | G05F 3/30 |
| 2011/0227636 | A1 * | 9/2011 | Endo | G05F 3/30<br>327/541 |
| 2012/0212194 | A1 * | 8/2012 | Tachibana | G05F 3/30<br>323/268 |
| 2012/0286848 | A1 * | 11/2012 | Scilla | H01L 27/0629<br>327/525 |
| 2013/0015834 | A1 | 1/2013 | Glibbery | |
| 2013/0069616 | A1 * | 3/2013 | Venkiteswaran | G05F 3/30<br>323/313 |
| 2013/0241522 | A1 | 9/2013 | Youssefi | |
| 2013/0314068 | A1 | 11/2013 | Zhen et al. | |
| 2014/0055166 | A1 * | 2/2014 | Kotowski | G05F 3/30<br>327/55 |
| 2016/0018839 | A1 * | 1/2016 | Cocetta | G05F 3/30<br>323/314 |

* cited by examiner

BANDGAP REFERENCE CIRCUIT AND METHOD FOR ROOM TEMPERATURE TRIMMING WITH REPLICA ELEMENTS

TECHNICAL FIELD

The present document relates to a bandgap reference circuit. In particular, the present document relates to providing a precise bandgap reference voltage across a wide range of temperatures.

BACKGROUND

Various circuits and trimming methods allow removing sources of error that affect the accuracy of a CMOS bandgap reference. Such errors may be due to process variations, mismatch and package-induced stresses.

SUMMARY

The present document addresses the technical problem of providing a bandgap reference circuit and a trimming method, which allows for a single-trim at room temperature and which allows for a precise bandgap reference voltage across a wide range of temperatures. According to an aspect, a bandgap reference circuit is described. The bandgap reference circuit comprises a first diode which is arranged in series with a first resistor between a reference point and a reference potential. Furthermore, the bandgap reference circuit comprises a second diode which is arranged in series with a second resistor and a third resistor between the reference point and the reference potential. In addition, the bandgap reference circuit comprises a trimming network which is arranged in series with a current source between the reference point and a supply voltage, wherein a bandgap reference voltage is provided at a midpoint between the trimming network and the current source. Furthermore, the bandgap reference circuit comprises an operational amplifier, wherein a first input of the operational amplifier is coupled to a midpoint between the first diode and the first resistor, wherein a second input of the operational amplifier is coupled to a midpoint between the second resistor and the third resistor, and wherein an output of the operational amplifier is used to control the current source. In addition, the bandgap reference circuit comprises replica elements of the first diode and of the first resistor, wherein a resistance of the trimming network is set based on a first diode voltage measured using the replica element of the first diode and based on a first resistance of the replica element of the first resistor.

According to an aspect, a method for trimming a bandgap reference circuit is described. The method comprises measuring a first diode voltage across a replica element of the first diode; determining a first resistance of a replica element of the first resistor; and setting a resistance of the trimming network of the bandgap reference circuit using the first diode voltage and the first resistance.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

As outlined above, the present document is directed at providing a circuit topology and a method for trimming a bandgap reference circuit at a single temperature, e.g. at room temperature. As a result of this, a high precision reference voltage over a wide temperature range may be provided.

In the present document, the following terms and abbreviations are used:

T Absolute temperature in ° C.+273 K;

PTAT Proportional-to-absolute-temperature for T;

Non-PTAT nonlinear curvature term for T;

$k_B$ and q Boltzmann constant and electron charge, i.e. $k_B=1.36*10^{-23}$ and $q=1.602*10^{-19}$;

$V_T$ Thermal voltage=n*($k_B$/q)*(T in ° C.+273), where n is the ideality factor of the emitter-based junction;

$V_{BE}$ BJT-based diode voltage $V_{BE}=V_T*Ln(I_C/I_S)$, where $I_S$ is the emitter saturation current and $I_C$ is the collector current;

$\Delta V_{BE}$ PTAT voltage=$V_{BE}(I_C)-V_{BE}(I_C/N)=V_T*Ln(N)$ of two BJT-based diodes having an emitter area ratio N (wherein N=14 in the illustrated examples);

$R_{PPLUS}$ $P^+$-diffusion resistor having typically a positive temperature coefficient;

$R_{PHRIP}$ Lightly-doped high-resistive polysilicon resistor having typically a negative temperature coefficient; also referred to as $R_{PHRIPOLY}$;

Chopping Continuous frequency modulation at a reference frequency;

Notching All pass filter with amplitude attenuation at a reference frequency.

Figure 1A:
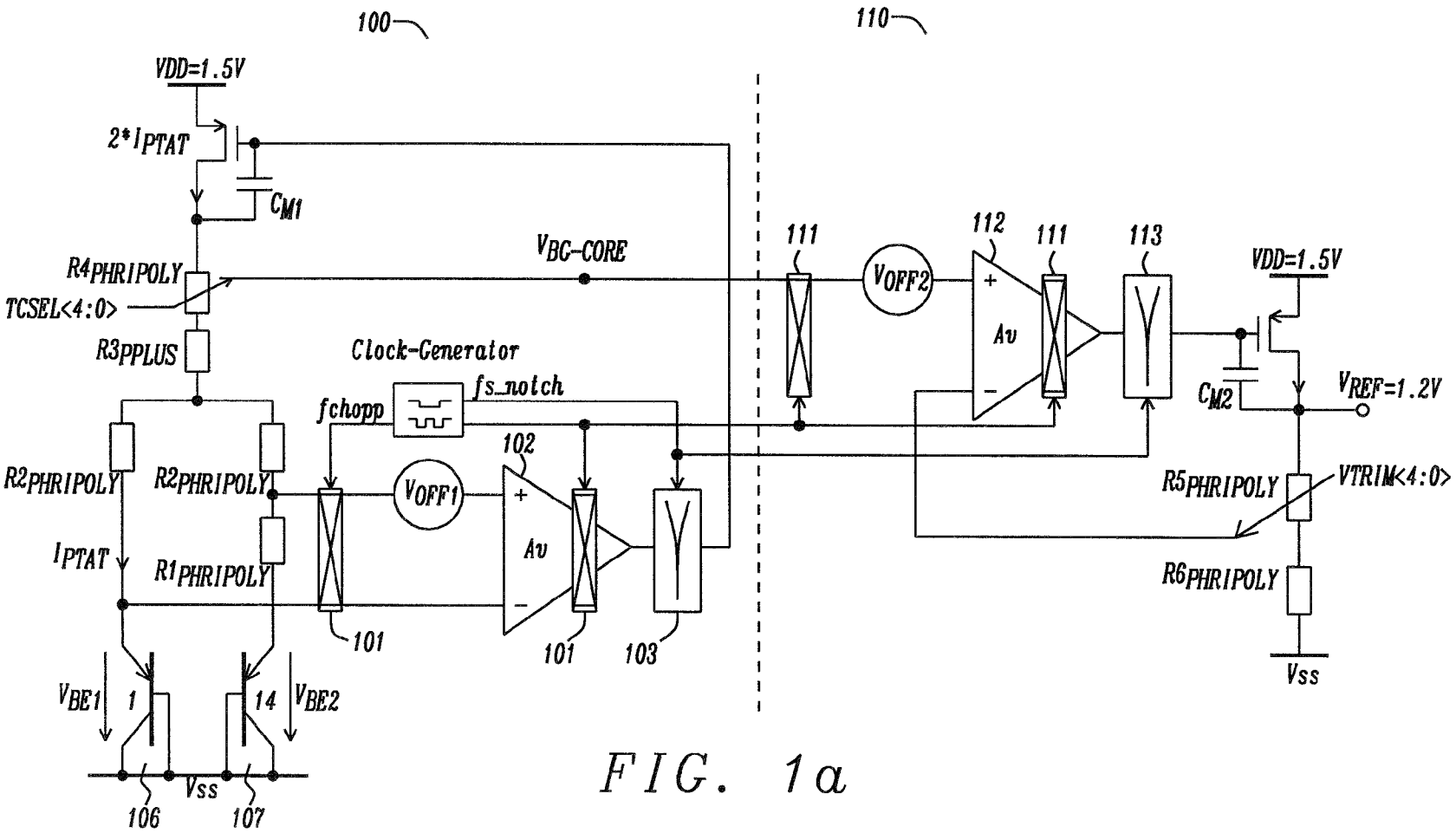
FIG. 1*a* illustrates a block diagram of an example bandgap reference circuit.

As shown in FIG. 1*a*, referring to the input of the first operational amplifier 102 being V+=V− while 1/Av~0 where Av is the open-loop gain of the first operational amplifier 102, the bandgap reference voltage $V_{BG-CORE}$ may be obtained as $$V_{BG-CORE} = V_{BE1} + \left(\frac{R2_{PHRIPOLY} + 2R4_{PHRIPOLY}}{R1_{PHRIPOLY}} + \frac{2R3_{PPLUS}}{R1_{PHRIPOLY}}\right) * (\Delta V_{BE1,2} + V_{OFF1}) = V_{BE1} + \alpha * (\Delta V_{BE1,2} + V_{OFF1})$$

$V_{OFF1}$ is the offset of the first operational amplifier 102. The offset $V_{OFF1}$ appears within the bandgap reference voltage $V_{BG-CORE}$ amplified by a resistive gain of α. The error caused by the offset $V_{OFF1}$ cannot be effectively reduced by PTAT trimming, since the offset drift of the MOSFETs comprised within the first operational amplifier 102 is non-PTAT. $V_{BE1}$ and $V_{BE2}$ are the base-emitter voltages of the PNP bipolar transistors 106, 107 (i.e. of the BJT-based diodes 106, 107) which exhibit an area ratio N=14 in the illustrated example. $\Delta V_{BE1,2}$ is the PTAT voltage.

FIG. 1*a* illustrates a bandgap core 100 (on the left hand side) and a voltage buffer 110 (on the right hand side). The bandgap core 100 is configured to provide the bandgap reference voltage $V_{BG-CORE}$ The voltage buffer 110 is configured to derive a reference voltage $V_{REF}$ based on the bandgap reference voltage $V_{BG-CORE}$.

Figure 1B:
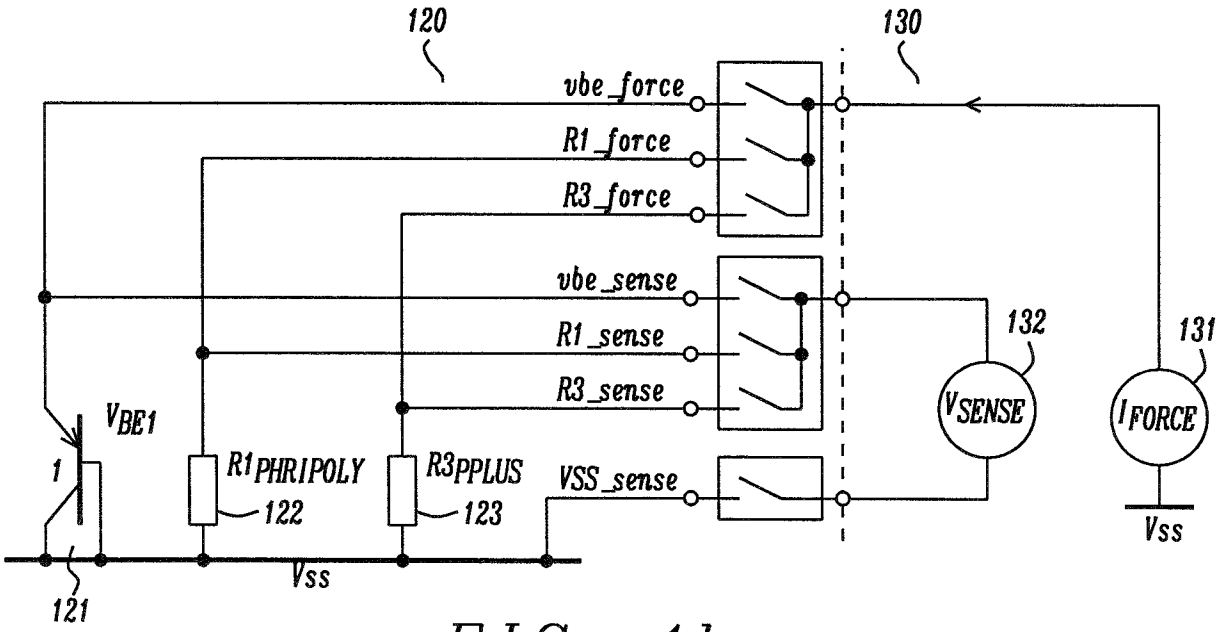
FIG. 1*b* shows circuitry for measuring replica elements of the bandgap reference circuit.

FIG. 1*b* illustrates on-chip replica elements 120 (on the left hand side) and off-chip measurement circuitry 130. In particular, on-chip replica elements may be provided for the first BJT-based diode 106 of FIG. 1*a* (replica element 121), for $R1_{PHRIPOLY}$ (replica element 122) and for $R3_{PPLUS}$ (replica element 123). Using the current source 131 a current $I_{FORCE}$ may be provided to a selected one of the replica elements 121, 122, 123 and the voltage drop at the respective replica element 121, 122, 123 may be sensed using voltage sensing means 132. As such, $V_{BE1}$, $R1_{PHRIPOLY}$ and/or $R3_{PPLUS}$ may be determined in a precise manner using the circuitry shown in FIG. 1*b*.

Figure 2:
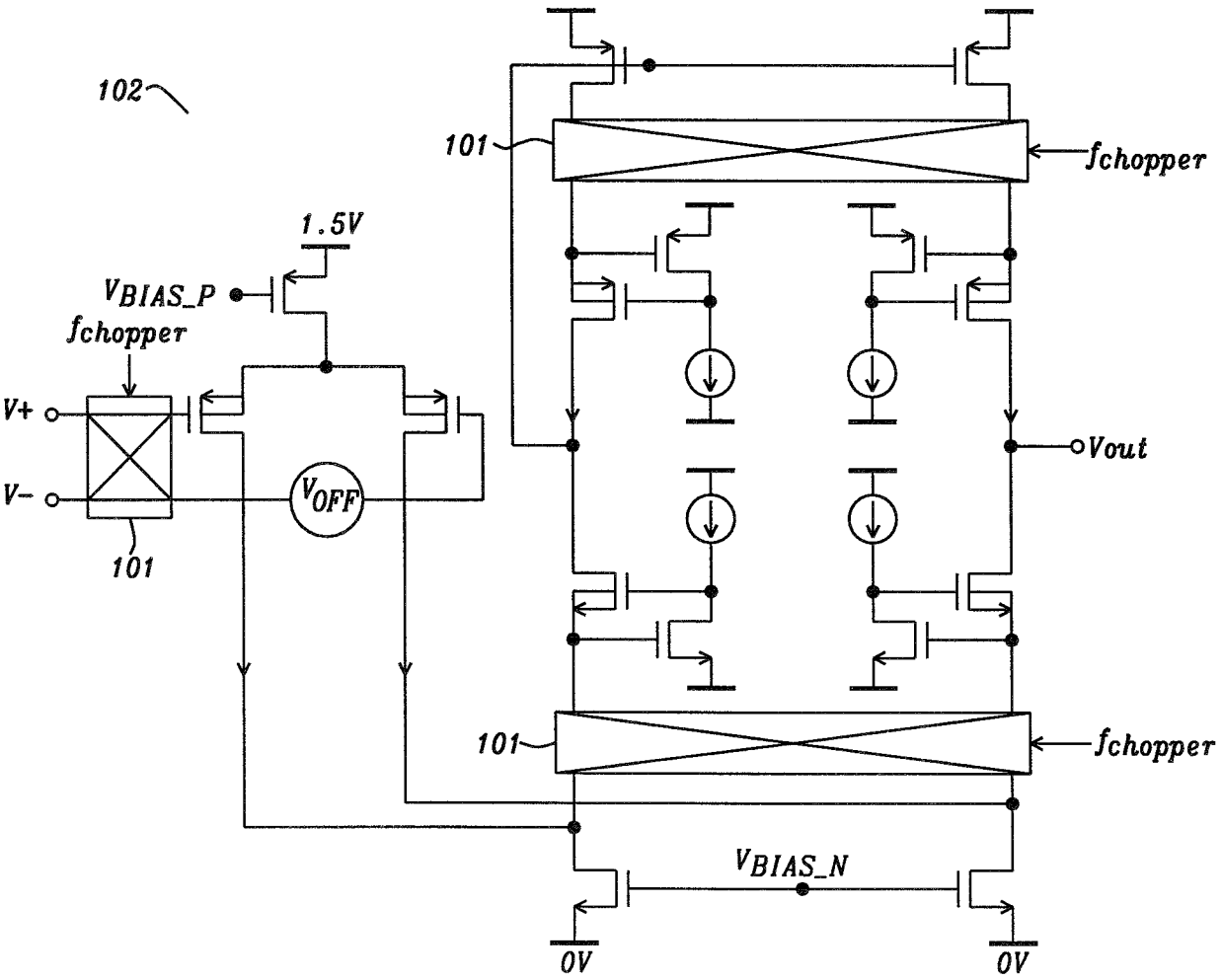
FIG. 2 shows a circuit diagram of an example operational amplifier.

A chopping technique may be used to modulate the offsets $V_{OFF1}$ and $V_{OFF2}$ in FIG. 1*a* of the first operational amplifier 102 and of the second operational amplifier 112 as well as the 1/f noise to the chopping frequency $f_{CHOPP}$. For this purpose chopper switches 101, 111 are provided. Chopping results in offset cancellation and superior noise performance, while at the same time ensuring that the outputs of the operational amplifiers 102, 112 are continuously available. FIG. 2 illustrates a detailed circuit diagram of an operational amplifier 102 and chopper switches 101.

Figure 3A:
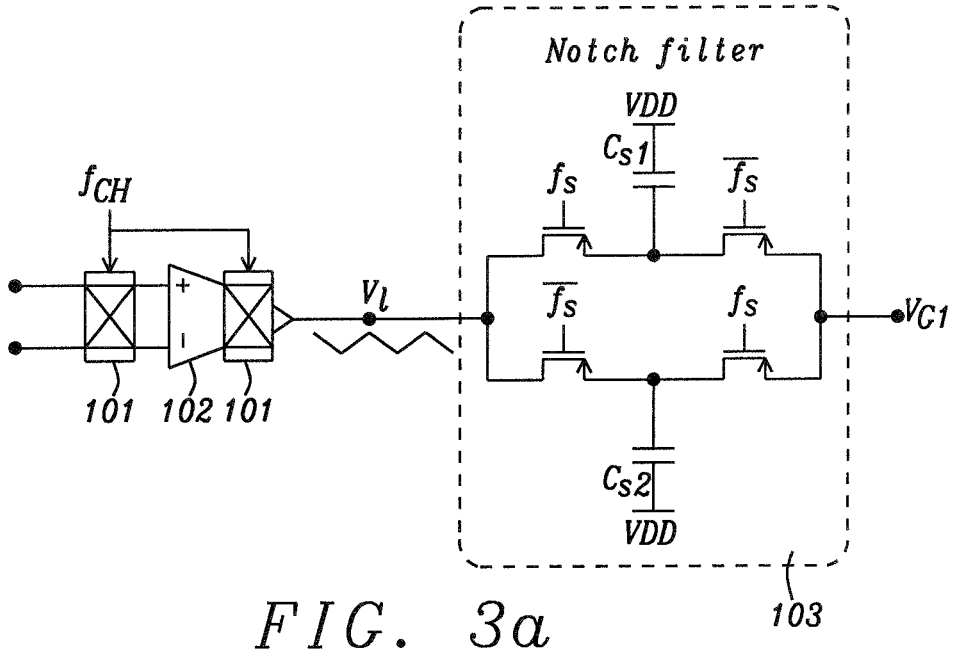
FIG. 3*a* shows a circuit diagram of an example notch filter.
Figure 3B:
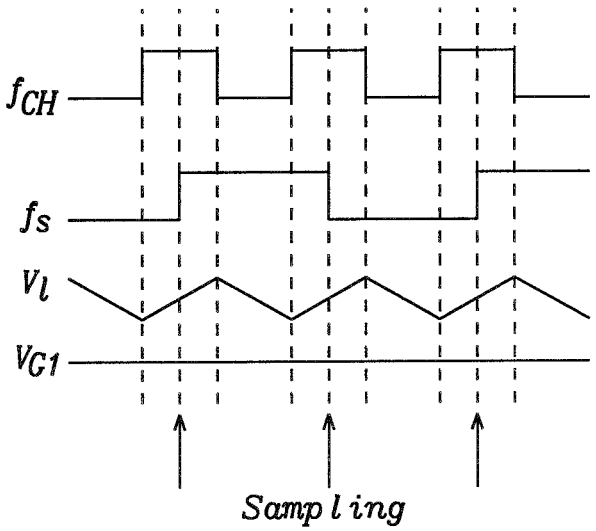
FIG. 3*b* shows example signals at a notch filter.
Figure 3C:
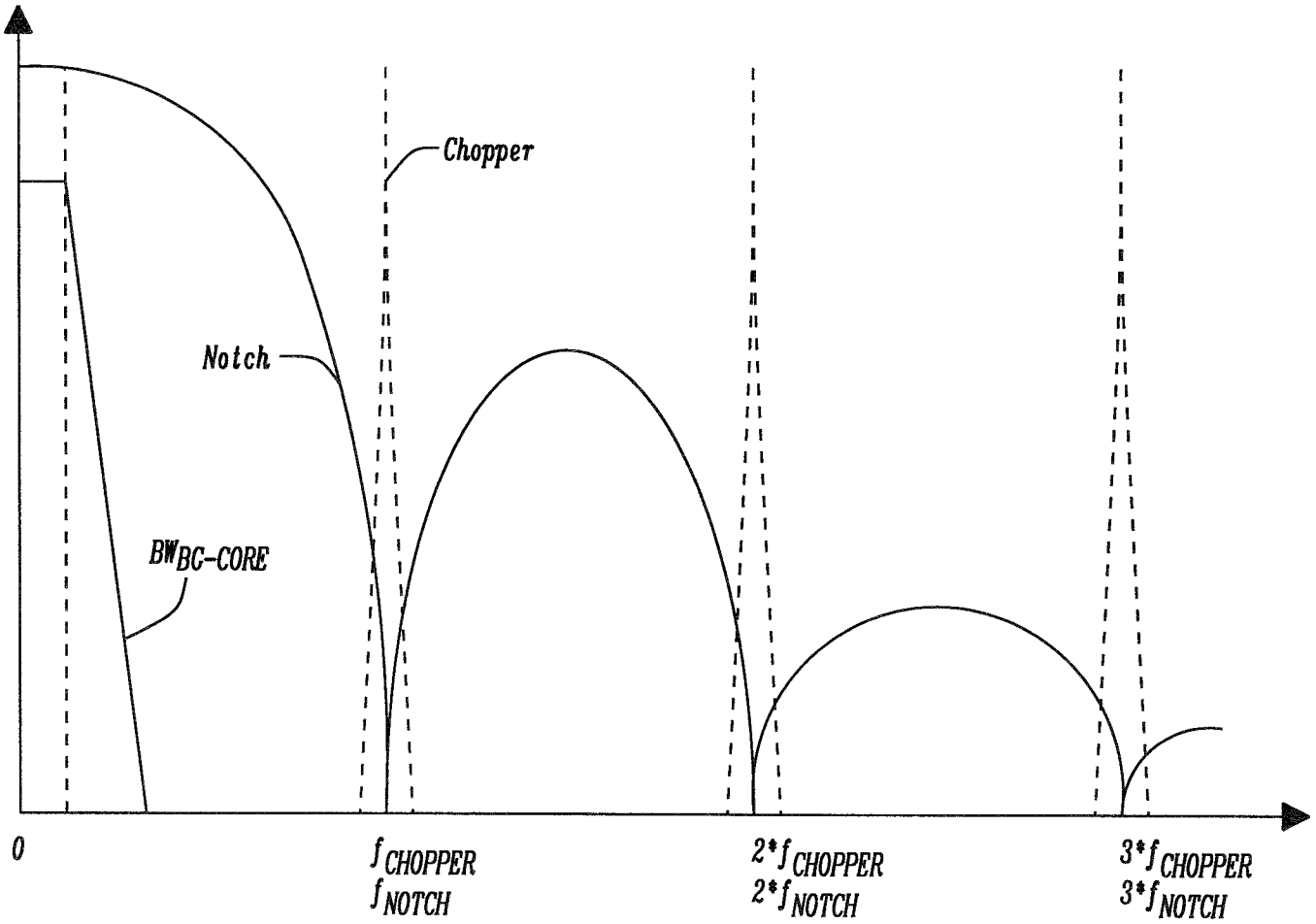
FIG. 3*c* shows an example frequency response of a notch filter.

The chopper's up-modulation of the offsets $V_{OFF1}$ or $V_{OFF2}$ results in ripple, which may be removed by switched-capacitor notch filters 103, 113, which are configured in Ping-Pong mode to provide full-period output signals. The sampling frequency $f_S=f_{S_NOTCH}$ of the notch filter 103, 113 is half of the chopping frequency $f_{CH}=f_{CHOPP}$ resulting in notches at the chopping frequencies. FIGS. 3*a*, 3*b* and 3*c* show a circuit diagram of a switched-capacitor notch filter 103, 113 (FIG. 3*a*), the sampling clock $f_S=f_{S_NOTCH}$ and notch frequency $f_{NOTCH}$, which are related to the chopper frequency $f_{CH}=f_{CHOPP}$ (FIG. 3*b*), and an example frequency response of the switched-capacitor notch filter 103, 113 (FIG. 3*c*).

In order to provide a bandgap reference voltage $V_{BG-CORE}$ with PTAT temperature dependency, $2^{nd}$-order curvature compensation of the BJT-based diode voltage $V_{BE1}$ may need to be performed. In the following a method for achieving $2^{nd}$-order curvature compensation is described.

The base-emitter voltage $V_{BE1}$ of the PNP bipolar transistor 106 decreases with temperature and can be approximated by its Taylor expansion at room temperature RT:

$$V_{BE1}(T)=b_0+b_1*(T-RT)+b_2*(T-RT)^2.$$

Figure 4:
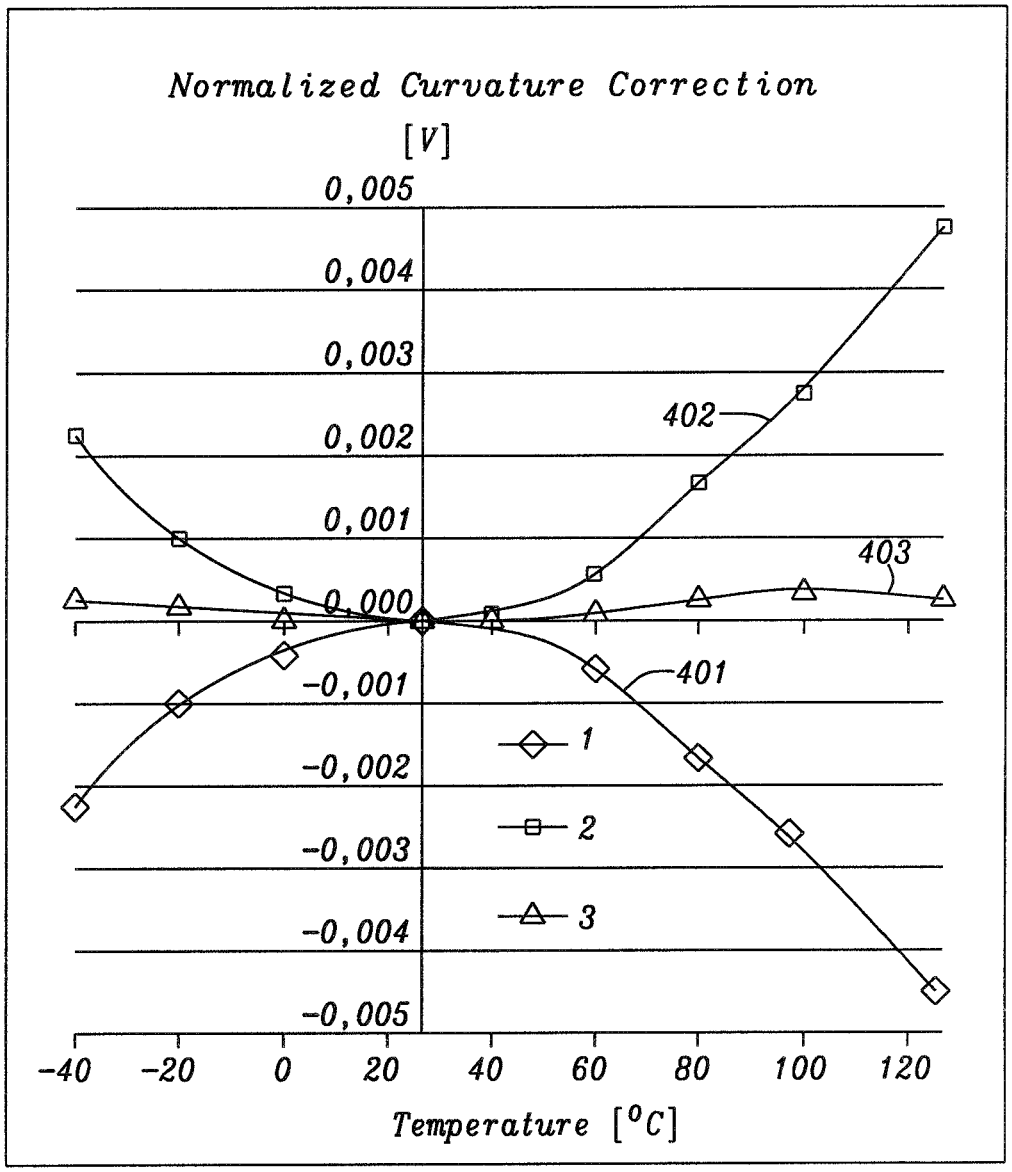
FIG. 4 illustrates the curvature correction of the base-emitter voltage of a BJT transistor.

The coefficients $b_0$, $b_1$, $b_2$ are derived by the process where $b_0$ is voltage constant, and where $b_1$ and $b_2$ are negative first-order and second-order temperature coefficients. FIG. 4 illustrates an example curve 401 of the base-emitter voltage $V_{BE1}$ as a function of the temperature.

The PTAT voltage $\Delta V_{BE1,2}$ is a thermal voltage that increases linearly with temperature $$\Delta V_{BE1,2}=V_{BE}(I_{PTAT})-V_{BE}(I_{PTAT}/14)=n*\mathrm{Ln}(N=14)*(k_B*T/q)$$

where $k_B$ is Boltzmann's constant, T is the absolute temperature, q is the quantity of electronic charge, N is the ratio of the PNP's 106, 107 emitter areas, and n is the ideality factor of the emitter-based junction.

The resistor ratio $(R2_{PHRIPOLY}+2R4_{PHRIPOLY})/R1_{PHRIPOLY}$ is temperature independent, because the resistors are implemented by the same material of high-resistive polysilicon.

The resistor ratio $2R3_{PPLUS}/R1_{PHRIPOLY}$ is temperature dependent due to different materials of high-resistive polysilicon and p+-diffusion. From the data of an example TSMC013 process, the temperature coefficients are given as $TC1_{RPHRIPOLY}$=−0.7*10-3/K and $TC1_{RPPLUS}$=+1.2*10-3/K, respectively. The TSMC013 process makes use of the process parameters from 0.13 μm CMOS technology of the Taiwan Semiconductor Manufacturing Company.

The resistor ratio $R3_{PPLUS}/R1_{PHRIPOLY}$ can be 1st-order linearized by its Taylor expansion at room temperature $$\frac{R3_{PPLUS}}{R1_{PHRIP}} = \frac{R3_{PPLUS}(RT)*(1+TC1_{RPPLUS}*(T-RT))}{R1_{PHRIP}(RT)*(1+TC1_{RPHRIP}*(T-RT))} = \frac{R3_{PPLUS}(RT)}{R1_{PHRIP}(RT)}*(1+(TC1_{RPPLUS}-TC1_{RPHRIP})*(T-RT))$$

The term $\alpha*\Delta V_{BE1,2}$ within the formula for the bandgap reference voltage $V_{BG-CORE}$ contains a PTAT term and a $2_{nd}$-order temperature coefficient $$\alpha*\Delta V_{BE1,2} = \alpha_1*RT + (\alpha_1+\alpha_2*RT)*(T-RT) + \alpha_2*(T-RT)^2$$

$$\alpha_1 = \left(\frac{R2_{PHRIP} + 2(R4_{PHRIP} + R4trim_{PHRIP})}{R1_{PHRIP}} + \frac{2R3_{PPLUS}(RT)}{R1_{PHRIP}(RT)}\right)*\frac{\Delta V_{BE1,2}}{T}$$

$$\alpha_2 = \frac{2R3_{PPLUS}(RT)}{R1_{PHRIP}(RT)}*(TC1_{RPPLUS}-TC1_{RPHRIP})*\frac{\Delta V_{BE1,2}}{T}$$

In the above formulas, the term "PHRIPOLY" has been abbreviated by the term "PHRIP". The part of $\alpha_1$, which involves the resistor $R4trim_{PHRIP}$, is made adjustable by trimming. $\alpha_2$ across the resistor $R3_{PPLUS}$ is chosen appropriately constant as $\alpha_2=b_2$, thereby removing the second order curvature.

FIG. 4 illustrates the $2^{nd}$-order curvature compensation of the base-emitter voltage $V_{BE1}$ of the PNP bipolar transistor 106. In particular, FIG. 4 illustrates the curvature voltage 401 of $V_{BE1}$, the curvature voltage 402 of $(2R3_{PPLUS}/R1_{PHRIP})*\Delta V_{BE1,2}(N=14)$ and the compensated curvature voltage 403 of $V_{BE1}$.

Once the first offset $V_{OFF1}$ is removed and the curvature in $V_{BE1}$ is compensated by $\alpha_2=b_2$, the bandgap reference voltage $V_{BG-CORE}$ exhibits mainly PTAT temperature dependency. This PTAT temperature dependency can be removed by a single PTAT trim at room temperature $$V_{BG-CORE} = V_{BE1} + \alpha * \Delta V_{BE} = (b_0 + \alpha_1 * RT) + (b_1 + \alpha_1 + \alpha_2 * RT) * (T - RT)$$

$$\frac{dV_{BG-CORE}}{dT} = 0 \rightarrow b_1 + \alpha_{1_LOWEST_TC} + \alpha_2 * RT = 0$$

$$V_{BG-CORE_LOWEST_TC} = b_0 + \alpha_{1_LOWEST_TC}$$

The $V_{BG-CORE_LOWEST_TC}$, which is the room temperature voltage for which the least temperature-drift variation is achieved, is unique to each PNP bipolar transistor 106.

Figure 5A:
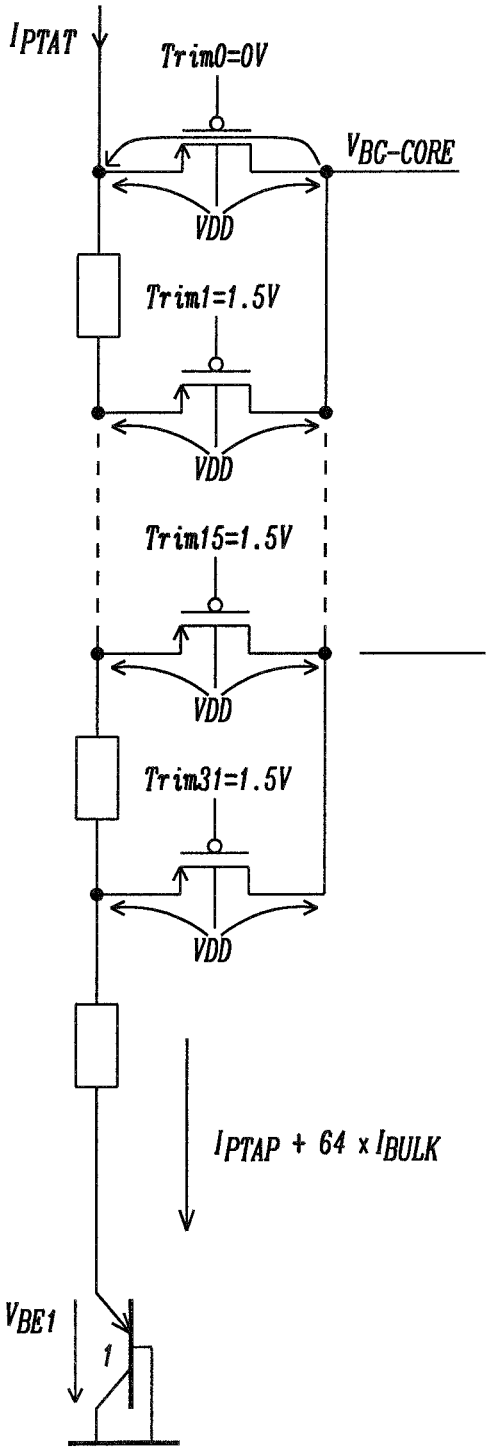
FIGS. 5*a* and 5*b* show example networks for trimming the resistor $R4_{PHRIPOLY}$.
Figure 5B:
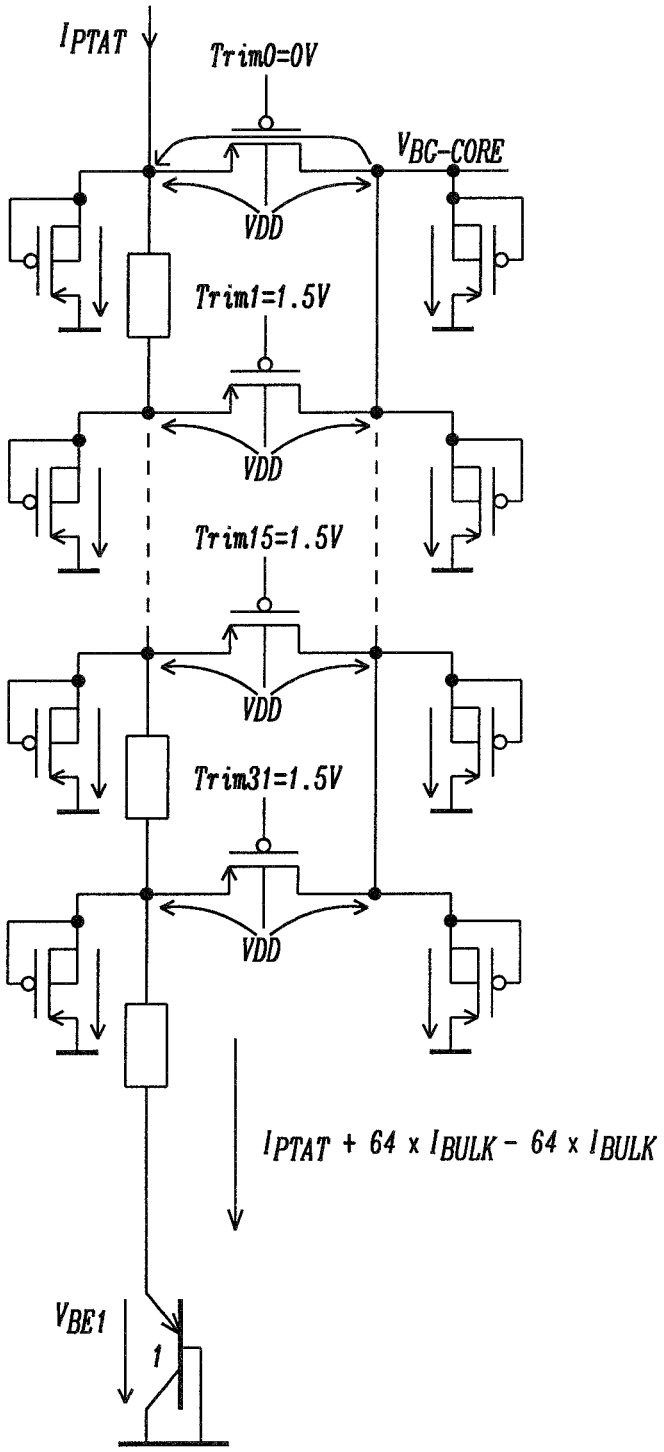

FIGS. 5*a* and 5*b* illustrate a trim-network and leakage current compensation. The illustrated trim-network uses PMOS switches such that leakage currents $i_{BD}$ and $i_{BS}$ are compensated.

After chopping and $2^{nd}$-order curvature-compensation, the bandgap reference voltage $V_{BG-CORE}$ exhibits mainly PTAT temperature dependency as $$V_{BG-CORE} = V_{BE}(I_{PTAT}) + \alpha * \Delta V_{BE} = V_{BE}(I_{PTAT}) + \alpha_1 * T,$$

where $$\alpha_1 = \left(\frac{R2_{PHRIP} + 2(R4_{PHRIP} + R4trim_{PHRIP})}{R1_{PHRIP}} + \frac{2R3_{PPLUS}(RT)}{R1_{PHRIP}(RT)}\right) * \frac{\Delta V_{BE}(N = 14)}{T}$$

The residual errors of the bandgap reference voltage $V_{BG-CORE}$ are caused by the process variations and packaging-induced stresses of $V_{BE}$ ($I_{PTAT}$), $\Delta V_{BE}$ (N=14), and the resistor ratio ($2R3_{PPLUS}$(RT)/$R1_{PHRIP}$(RT)) that are deviated from their nominal value. The bandgap reference voltage $V_{BG-CORE}$ can be written as $$V_{BG-CORE,NOM} - \underline{\Delta(V_{BE}(I_{PTAT}))} - \frac{\Delta V_{BE,NOM}}{T} * \underline{\Delta\left(\frac{2R3_{PPLUS}(RT)}{R1_{PHRIP}(RT)}\right)} - \frac{\alpha_{1,NOM}}{T} * \underline{\Delta(\Delta V_{BE})}$$

The resulting errors are PTAT and caused by the deviations of $V_{BE}$, $\Delta V_{BE}$ (N=14), $R1_{PHRIP}$(RT) and $R3_{PPLUS}$(RT) from their nominal values. The resulting errors can be removed by a single PTAT trim at room temperature with measurements on their replica elements 121, 122, 123 at room temperature RT.

Figure 6:
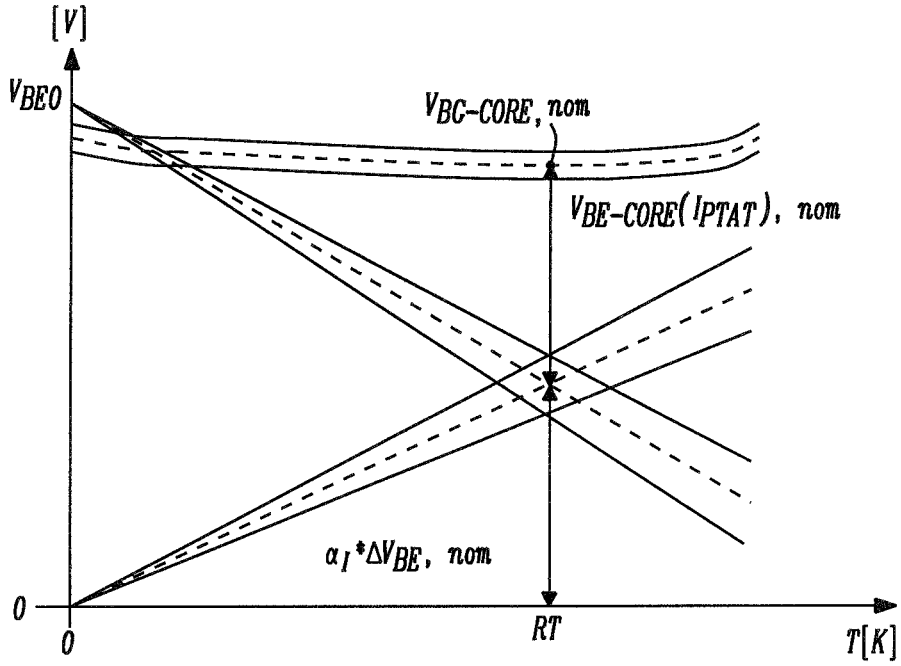
FIG. 6 illustrates a single-trim at room temperature.

FIG. 6 illustrates a single-trim at room temperature RT. The PTAT and Voltage trimming at room temperature may be performed as follows. As shown in FIG. 1*a*, the PTAT trimming may be performed with TCSEL<4:0> and $TCSEL_{NOM}$=16, while the voltage trimming may be performed with VTRIM<4:0> of the voltage buffer 110, where the offset of the voltage buffer 110 is removed by the chopping and notching as well. TCSEL<4:0> is the 5-bit trim-code of the PTAT trimming, the highest trim code systematically produces the highest TC in $V_{BG-CORE}$ and the lowest trim code the lowest TC, TCSEL<4:0>=11111 (or 31) and TCSEL<4:0>=00000 (or 0), respectively. The nominal TCSEL value is $TCSEL<4:0>_{NOM}$=10000 (or 16). VTRIM<5:0> is the 5-bit trim-code of the buffered voltage to obtain an output voltage of 1.2 V.

In a first step, $R3_{PPLUS}$ and $R1_{PHRIP}$ are measured to obtain $TCSEL_1$ related to $(2R3_{PPLUS}/R1_{PHRIP})_{NOM}$. The measurements may be performed based on the replica elements 122, 123. As a result of this measurement, the values $R3_{PPLUS,MEAS}$ and $R1_{PHRIP,MEAS}$ may be determined. The nominal values $R3_{PPLUS,NOM}$, $R1_{PHRIP,NOM}$ and $\alpha_{1_TRIM_STEP,NOM}$ are given by the design of the bandgap reference circuit 100.

$$TCSEL_1 = \frac{1}{\alpha_{1_TRIM_STEP,NOM}} * \left(\frac{2R3_{PPLUS,NOM}}{R1_{PHRIP,NOM}} - \frac{2R3_{PPLUS,MEAS}}{R1_{PHRIP,MEAS}}\right).$$

In a second step, $\Delta V_{BE}$(N=14) is measured to obtain $TCSEL_2$ related to $\alpha_{1,NOM} * \Delta V_{BE}$ $(N=14)_{NOM}$. The measurements may be performed based on the replica element 121 (and possibly a replica element for the second BJT-based diode 107). As a result of this measurement, the values $V_{BE,MEAS}(I_{PTAT,NOM})$ and $V_{BE,MEAS}(I_{PTAT,NOM}/14)$ are obtained. The nominal values are given by the design of the bandgap reference circuit 100.

$$TCSEL_2 = \alpha_{1,NOM} * \left(1 - \frac{V_{BE,MEAS}(I_{PTAT,NOM}) - V_{BE,MEAS}(I_{PTAT,NOM}/14)}{\Delta V_{BE,NOM} = \mathrm{Ln}(14) * (k_B/q) * (273 + RT)}\right).$$

In a third step, $V_{BE}$ ($I_{PTAT}$) is measured to obtain $TCSEL_3$ related to $V_{BE}(I_{PTAT})_{NOM}$ $$I_{PTAT,MEAS} = \frac{V_{BE,MEAS}(I_{PTAT,NOM}) - {}_{BE,MEAS}\ (I_{PTAT,NOM}/14)}{R1_{PHRIP,MEAS}},$$

and $$TCSEL_3 = \frac{\lfloor V_{BE,MEAS}(I_{PTAT,NOM}) - V_{BE,MEAS}(I_{PTAT,MEAS})\rfloor}{\alpha_{1_TRIM_STEP,NOM} * \Delta V_{BE,NOM}}.$$

In a fourth step, $TCSEL_{LOWEST_TC}$=$TCSEL_{NOM}$+$TCSEL_1$+$TCSEL_2$+$TCSEL_3$ is determined. $V_{BG-CORE_LOWEST_TC}$ is the $V_{BG-CORE}$ trimmed with $TCSEL_{LOWEST_TC}$ and $V_{REF}$ is trimmed with VTRIM <4:0> to $$V_{REF} = V_{BG-CORE_LOWEST_TC} * \left(1 + \frac{R5_{PHRIP} - R5trim_{PHRIP}}{R6_{PHRIP} + R5trim_{PHRIP}}\right) = 1.2\ \mathrm{V}$$

Figure 7:
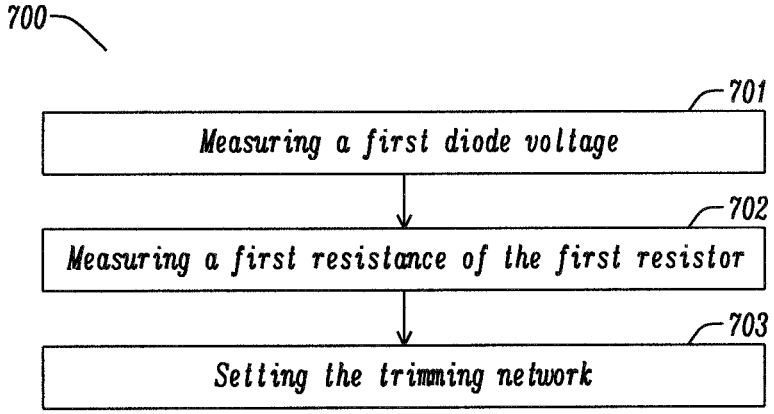
FIG. 7 shows a flow chart of an example method for trimming a bandgap reference circuit.

FIG. 7 shows a flow chart of an example method 700 for trimming a bandgap reference circuit 100. As outlined in the context of FIG. 1*a*, the bandgap reference circuit 100 comprises a first diode 106 which is arranged in series with a first resistor (identified as $R2_{PHRIPOLY}$ in FIG. 1*a*) between a reference point and a reference potential $V_{SS}$ (e.g. ground). The first diode 106 may comprise a bipolar junction transistor (BJT). The first diode 106 may be directly coupled to the reference potential $V_{SS}$ and the first resistor may be directly coupled to the reference point.

Furthermore, the bandgap reference circuit 100 comprises a second diode 107 which is arranged in series with a second resistor (identified as in FIG. 1*a*) and a third resistor (identified as $R2_{PHRIPOLY}$ in FIG. 1*a*) between the reference point and the reference potential $V_{SS}$. The first resistor and the third resistor may have the same resistance. The second diode 107 may be directly coupled to the reference potential $V_{SS}$ and the second and third resistors may form a resistor divider which is directly coupled to the reference point. The second diode may comprise a bipolar junction transistor. Furthermore, the first and second diodes may have a predetermined emitter area ratio N. In particular, the second diode may have an emitter area which is larger than the emitter area of the first diode by a factor N. This is due to $\Delta V_{BE1,2}=V_T*Ln[(I_{C1}/I_{C2})*(AREA_2/AREA_1)]$. Therefore, $\Delta V_{BE1,2}(N=14)=V_T*Ln[(I_{C1}/I_{C2})]$ when $AREA_2=AREA_1$.

$\Delta V_{BE1,2}$ $(N=14)=V_T*Ln[AREA_2/AREA_1)]$ when $I_{C1}=I_{C2}$.

In addition, the bandgap reference circuit 100 comprises a trimming network (identified as $R4_{PHRIPOLY}$, in FIG. 1*a*) which is arranged in series with a current source between the reference point and a supply voltage $V_{DD}$. The trimming network may have an adjustable resistance. In particular, the trimming network may comprise a plurality of transistors for increasing or decreasing the resistance of the trimming network. The current source may comprise a transistor (e.g. a MOS transistor) having a gate. A bandgap reference voltage $V_{BG\text{-}CORE}$ may be provided at a midpoint between the trimming network and the current source.

In addition, the bandgap reference circuit 100 comprises an operational amplifier 102, wherein a first input of the operational amplifier 102 is coupled to a midpoint between the first diode 106 and the first resistor. A second input of the operational amplifier 102 may be coupled to a midpoint between the second resistor and the third resistor. Furthermore, an output of the operational amplifier 102 may be used to control the current source. For this purpose, the output of the operational amplifier 102 may be coupled to the gate of a transistor of the current source.

Furthermore, the bandgap reference circuit 100 comprises replica elements 121, 122 of the first diode 106 and of the first resistor. The replica element of a component of the bandgap reference circuit 100 may comprise a copy of this component. In other words, the replica element of a component may exhibit the same nominal parameters (e.g. dimensions) as the component itself. Such replica elements 121, 122 may be used for an efficient trimming of the bandgap reference circuit 100. In particular, a resistance of the trimming network may be set based on a first diode voltage measured using the replica element 121 of the first diode 106 and based on a first resistance of the replica element 122 of the first resistor.

As such, the method 700 for trimming the bandgap reference circuit 100 may comprise measuring 701 the first diode voltage across the replica element 121 of the first diode 106. Furthermore, the method 700 comprises determining 702 the first resistance of the replica element 122 of the first resistor. In addition, the method 700 comprises setting 703 the resistance of the trimming network using the first diode voltage and the first resistance.

By using the above mentioned trimming method which involves replica elements 121, to 122, a bandgap reference circuit 100 may be provided which delivers a precise bandgap reference voltage $V_{BG\text{-}CORE}$ over wide temperature ranges.

The bandgap reference circuit 100 may comprise a fourth resistor (identified as $R3_{PPLUS}$ in FIG. 1*a*) arranged between the trimming network and the reference point. Furthermore, the bandgap reference circuit 100 may comprise a replica element 123 of the fourth resistor. The method 700 may comprise determining a fourth resistance of the replica element 123 of the fourth resistor. The resistance of the trimming network may be set using also the fourth resistance. By doing this, the precision of the bandgap reference circuit 100 may be further increased.

The first diode voltage, the first resistance and/or the fourth resistance may be measured at room temperature. By doing this, the cost of trimming may be reduced.

The first, second and third resistors as well as the trimming network may comprise polysilicon resistors. As a result of this, a resistor ratio involving the first, second and third resistors and/or the trimming network may be independent of the temperature. By doing this, the precision of the bandgap reference circuit 100 may be further increased.

The fourth resistor may comprise a $P^+$-diffusion resistor. As a result of this, a ratio comprising the fourth resistor and the second resistor may exhibit a substantially linear temperature dependency, which may be beneficial for the trimming process.

The bandgap reference circuit 100 may comprise a chopper 101 at the first and second inputs of the operational amplifier 102. The chopper 101 may be operated such that an offset of the operational amplifier 102 is compensated. By doing this, the precision of the bandgap reference circuit 100 may be further increased.

The fourth resistor and the second resistor may be selected in dependence on a $2^{nd}$ order temperature coefficient of the first diode voltage. By doing this, a curvature of the first diode voltage may be compensated, leading to an increased precision of the bandgap reference circuit 100.

The bandgap reference circuit 100 may further comprise a voltage buffer 110 which is configured to provide a reference voltage $V_{REF}$ based on the bandgap reference voltage $V_{BG\text{-}CORE}$. The voltage buffer 110 may comprise a second current source arranged in series with a fifth resistor between the supply voltage and the reference potential. Furthermore, the voltage buffer 110 may comprise a second operational amplifier 112, wherein a first input of the second operational amplifier 112 is coupled to the midpoint between the trimming network and the current source. A second input of the second operational amplifier 112 may be coupled to a midpoint between the second current source and the fifth resistor. Furthermore, an output of the second operational amplifier 112 may be configured to control the second current source in order to set the reference voltage $V_{REF}$.

The voltage buffer 110 may further comprise a second trimming network arranged between the second current source and the fifth resistor. A midpoint between the second trimming network and the fifth resistor may be coupled to the second input of the second operational amplifier 112. The second trimming network may be set based on a first diode voltage measured using the replica element 121 of the first diode 106, based on a first resistance of the replica element 122 of the first resistor and based on a pre-determined value for the reference voltage $V_{REF}$. By doing this, a precise reference voltage $V_{REF}$ may be provided over a wide range of temperatures.

In the present document, a bandgap reference circuit 100 and a trimming method 700 have been described which allow for a single-trim e.g. at room temperature.

Furthermore, a precise bandgap reference voltage across a wide range of temperatures (e.g. −40° C. up to 125° C.) may be provided using the bandgap reference circuit 100 described in the present document.

The described bandgap reference circuit 100 may comprise only a single current source. Furthermore, offset chopping and notching of the operational amplifier 102 may be used, resulting in an accuracy of the bandgap reference voltage which does not dependent on the sensitivity of MOSFET devices comprised within the operational amplifier 102. $2^{nd}$-order curvature may be compensated using a temperature dependent resistor ratio. This may be enabled by using different materials of high-resistive poly (polysilicon) and p+-diffusion. PMOS switches may be used within the PTAT trimming network such that leakage current of $i_{BD}$ and $i_{BS}$, i.e. the leakage current of switches of the trim network, may be compensated. This current disrupts the precise current ratios necessary for temperature compensation (TC) as shown in FIG. 5*a*. The origin of bulk leakage current is a reverse-biased diode current between the well and drain or source regions of a MOSFET switch, and results in bulk-drain and bulk-source leakage current, $i_{BD}$ and $i_{BS}$, respectively. Leakage current from the switches may be compensated by the leakage current through a set of identical devices. Since the compensation devices are identical to the switches, the leakage current from the compensation devices will exactly track the leakage current from the switches as shown in FIG. 5*b*.

Furthermore, a single-trim method may be used to remove PTAT and voltage errors due to process variations and variation caused by package-induced stresses of $V_{BE}$, $\Delta V_{BE}$, and resistors. The described trim method involves measuring replica elements at room temperature.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A method for trimming a bandgap reference circuit, wherein for providing the bandgap reference circuit the method comprises the steps of:

arranging a first diode in series with a first resistor between a reference point and a reference potential;

arranging a second diode in series with a second resistor and a third resistor between the reference point and the reference potential;

arranging a trimming network in series with a current source between the reference point and a supply voltage; wherein the trimming network exhibits an adjustable resistance; wherein a bandgap reference voltage is provided at a midpoint between the trimming network and the current source; and coupling a first input of an operational amplifier to a midpoint between the first diode and the first resistor, wherein a second input of the operational amplifier is coupled to a midpoint between the second resistor and the third resistor, and wherein an output of the operational amplifier is used to control the current source;

wherein the method further comprises the steps of:

measuring a first diode voltage across a replica element of the first diode; the replica element of the first diode being a copy of the first diode;

determining a first resistance of a replica element of the first resistor; the replica element of the first resistor being a copy of the first resistor; and setting the resistance of the adjustable resistance of the trimming network using the first diode voltage and the first resistance.

2. The method according to claim 1, further comprising the steps of:

determining a fourth resistance of a replica element of the fourth resistor; and setting a resistance of the trimming network using the fourth resistance, wherein the bandgap reference circuit comprises a fourth resistor arranged between the trimming network and the reference point.

3. The method according to claim 2, wherein the fourth resistor and the second resistor are selected in dependence on a $2^{nd}$ order temperature coefficient of the first diode voltage.

4. The method according to claim 2, wherein the first resistor and the third resistor have the same resistance.

5. The method according to claim 1, further comprising the steps of:

providing the bandgap reference circuit which comprises a chopper at the first and second inputs of the operational amplifier; and operating the chopper such that an offset of the operational amplifier is compensated.

6. The method according to claim 1, wherein the first diode voltage is measured at room temperature.

7. A bandgap reference circuit comprising a first diode which is arranged in series with a first resistor between a reference point and a reference potential;

a second diode which is arranged in series with a second resistor and a third resistor between the reference point and the reference potential;

a trimming network which is arranged in series with a current source between the reference point and a supply voltage; wherein the trimming network exhibits an adjustable resistance; wherein a bandgap reference voltage is provided at a midpoint between the trimming network and the current source;

an operational amplifier, wherein a first input of the operational amplifier is coupled to a midpoint between the first diode and the first resistor, wherein a second input of the operational amplifier is coupled to a midpoint between the second resistor and the third resistor, and wherein an output of the operational amplifier is used to control the current source; arid replica elements of the first diode and of the first resistor; wherein the replica element of the first diode is a copy of the first diode; wherein the replica element of the first resistor is a copy of the first resistor; wherein the resistance of the adjustable resistance of the trimming network is set based on a first diode voltage measured using the replica element of the first diode and based on a first resistance of the replica element of the first resistor.

8. The bandgap reference circuit of claim 7, wherein the first diode is directly coupled to the reference potential;

the second diode is directly coupled to the reference potential;

the first resistor is directly coupled to the reference point; and the second and third resistor form a resistor divider which is directly coupled to the reference point.

9. The bandgap reference circuit of claim 7, wherein the first, second and third resistors are polysilicon resistors.

10. The bandgap reference circuit of claim 7, wherein the bandgap reference circuit comprises a fourth resistor arranged between the trimming network and the reference point; and the fourth resistor is a $P^+$—diffusion resistor.

11. The bandgap reference circuit of claim 7, further comprising a voltage buffer which is configured to provide a reference voltage $V_{REF}$ based on the bandgap reference voltage.

12. The bandgap reference circuit of claim 11, wherein the voltage buffer comprises a second current source arranged in series with a fifth resistor between the supply voltage and the reference potential; and a second operational amplifier, wherein a first input of the second operational amplifier is coupled to the midpoint between the trimming network and the current source, wherein a second input of the second operational amplifier is coupled to a midpoint between the second current source and the fifth resistor, and wherein an output of the second operational amplifier is configured to control the second current source in order to set the reference voltage.

13. The bandgap reference circuit of claim 12, wherein the voltage buffer comprises a second trimming network arranged between the second current source and the fifth resistor; wherein a midpoint between the second trimming network and the fifth resistor is coupled to the second input of the second operational amplifier; wherein the second trimming network is set based on a first diode voltage measured using the replica element of the first diode, based on a first resistance of the replica element of the first resistor and based on a pre-determined value for the reference voltage.

14. The bandgap reference circuit of claim 7, wherein the current source is a transistor having a gate that is controlled by the output of the operational amplifier.

15. The bandgap reference circuit of claim 7, wherein the first and second diodes each comprise a bipolar junction transistor; and/or the first and second diodes have a pre-determined emitter area ratio N.

* * * * *